US005369910A

United States Patent [19]

Copenhaver

[11] Patent Number: 5,369,910

[45] Date of Patent: Dec. 6, 1994

[54] CHRISTMAS TREE STAND WITH REMOTE WATERING SYSTEM

[76] Inventor: Michael J. Copenhaver, 234 Upper Mulberry St., Danville, Pa. 17821

[21] Appl. No.: 116,739

[22] Filed: Sep. 7, 1993

[51] Int. Cl.[5] ..... A47G 7/02

[52] U.S. Cl. ..... 47/40.5; 248/188.4; 248/528

[58] Field of Search ..... 47/40.5; 248/519, 523, 248/524, 528, 188.4, 188.7

[56] References Cited

U.S. PATENT DOCUMENTS

| | | | |
|---|---|---|---|
| 1,273,639 | 7/1918 | Lyons | 248/528 |
| 2,500,215 | 3/1950 | Swearingen | 47/40.5 |
| 2,531,690 | 11/1950 | Kennel | 47/40.5 |
| 3,469,342 | 9/1969 | Morris | 47/40.5 |
| 3,697,026 | 10/1972 | Hambrick | 47/40.5 |
| 4,368,869 | 1/1983 | Gelvezon et al. | 248/188.4 |
| 4,593,874 | 6/1986 | Dunagan | 248/188.4 |
| 4,930,252 | 6/1990 | Krause et al. | 47/40.5 |
| 5,076,009 | 12/1991 | Cibor | 47/40.5 |
| 5,157,868 | 10/1992 | Munoz | 47/40.5 |
| 5,201,140 | 4/1993 | Voorhis | 47/40.5 |

*Primary Examiner*—Ramon S. Britts
*Assistant Examiner*—Joanne C. Downs

[57] ABSTRACT

A tree stand for supporting a Christmas tree in an upright position has a remote watering box/water storage tank disguised to resemble a wrapped gift/Christmas present under the tree. Water can run through tubing positioned under the tree skirt from the bottom of the remote watering box to the bottom of the watertight tree stand. When a ball valve (or similar valve means) in the water line is opened, the level in the stand will rise to the level of the water in the tank. Water can be easily added to the watering box/storage tank to maintain it at the desired level without a person having to crawl under the tree. The tree stand has four legs which can fold up to give the stand a compact shape which can nest within the remote watering box reducing the amount of storage space required when the stand is not being used.

8 Claims, 4 Drawing Sheets

CHRISTMAS TREE STAND WITH REMOTE WATERING SYSTEM

BACKGROUND OF THE INVENTION

1. Field of the Invention

The present invention relates generally to Christmas tree stands, and more particularly, to a Christmas tree stand having a remote watering system especially adapted to permit watering the tree without climbing under the tree.

2. Description of the Prior Art

Christmas tree stands in the form of support devices for holding up live Christmas trees are well known in the prior art. Many of the prior art Christmas tree stands provide basins for holding water around the lower trunk of the tree to prevent the tree from drying out, which can be very dangerous since a dried out tree presents a serious fire threat (see for example U.S. Pat. No. 5,014,461 and U.S. Pat. No. 3,562,951). It is also known to have a Christmas tree watering stand in liquid communication with a water source (see for example U.S. Pat. No. 4,993,176 and U.S. Pat. No. 115,076,009 as well as U.S. Pat. Des. No. 319,416).

Thus, while the foregoing body of prior art indicates it to be well known to use Christmas tree stands in liquid communication with a water source, the provision of a more simple and cost effective device is not contemplated. Nor does the prior art described above teach or suggest a Christmas tree stand device with a remote watering box/reservoir shaped like a Christmas present which may be used by individuals to water their Christmas tree without crawling under the tree and for which, when not needed, the stand can be neatly folded up and placed inside the remote box/reservoir for easy storage. The foregoing disadvantages are overcome by the unique Christmas tree stand having a wrapped Christmas gift box shaped remote watering box/reservoir of the present invention as will be made apparent from the following description thereof. Other advantages of the present invention over the prior art also will be rendered evident.

SUMMARY OF THE INVENTION

To achieve the foregoing and other advantages, the present invention, briefly described, provides a tree stand for supporting a Christmas tree in an upright position having a remote watering box/water storage tank disguised to resemble a wrapped gift/Christmas present under the tree. Water can run through tubing positioned under the tree skirt from the bottom of the remote watering box to the bottom of the watertight tree stand. When a ball valve (or similar valve means) in the water line is opened, the level in the stand will rise to the level of the water in the tank. Water can be easily added to the watering box/storage tank to maintain it at the desired level without a person having to crawl under the tree. The tree stand has four legs which can fold up to give the stand a compact shape which can nest within the remote watering box reducing the amount of storage space required when the stand is not being used.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new Christmas tree stand with a remote watering system which has all of the advantages of the prior art and none of the disadvantages.

It is another object of the present invention to provide a new Christmas tree stand with a remote watering system which may be easily and efficiently manufactured and marketed.

It is a further objective of the present invention to provide a new Christmas tree stand with a remote watering system which is of durable and reliable construction.

An even further object of the present invention is to provide a new Christmas tree stand with a remote watering system which is susceptible of a low cost of manufacture with regard to both materials and labor, and which accordingly is then susceptible of low prices of sale to the consuming public, thereby making such Christmas tree stand with a remote watering system available to the buying public.

Still yet a further object of the present invention is to provide a new Christmas tree stand with a remote watering system in which a remote watering box/water storage tank is disguised to resemble a wrapped gift/-Christmas present sitting under the tree with water able to run through tubing positioned under the tree skirt from the bottom of the remote watering box to the bottom of the watertight tree stand.

It is still a further object of the present invention to provide a new Christmas tree stand with a remote watering system to provide a ball valve (or similar valve means) in the water line between the stand and the remote watering position such that when the valve is opened, the level in the stand will rise to the level of the water in the tank.

Still a further object of the present invention is to provide a new four legged Christmas tree stand with a remote watering system including means for folding the four legs up to give the stand a compact shape which can nest within a remote watering box reducing the amount of storage space required when the stand is not being used.

Even still a further object of the present invention is to provide a watering box/storage tank to which water can be easily and quickly added to maintain the box at the desired level without a person having to crawl under the tree.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved Christmas tree stand with a remote watering system embodying the principles and concepts of the present invention will be described.

Figure 1:
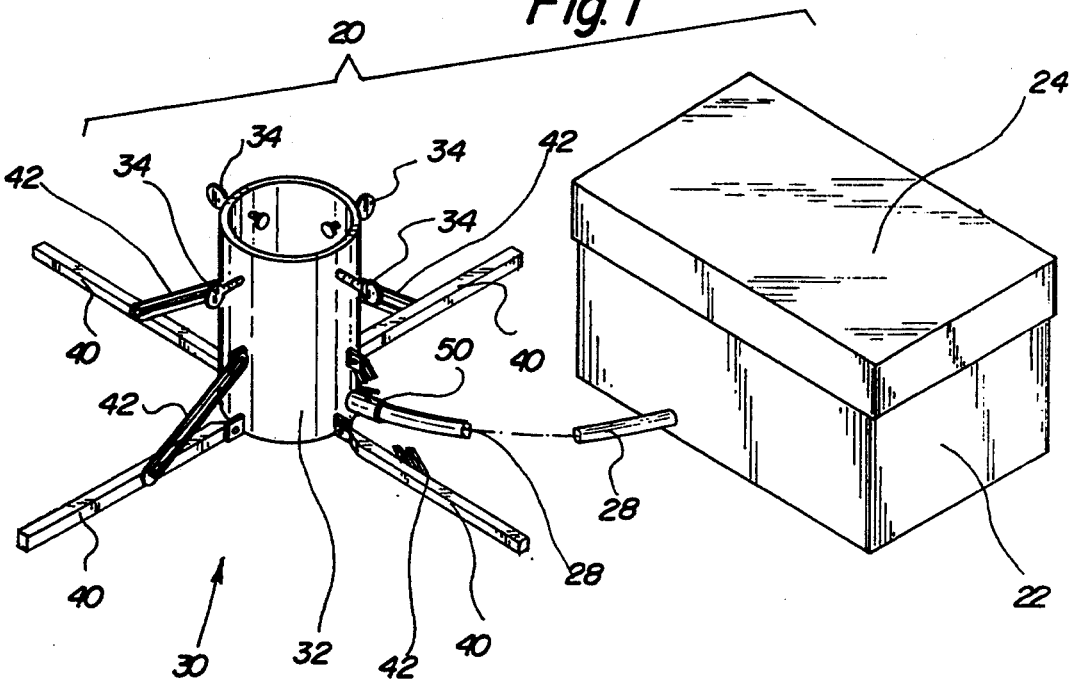
FIG. 1 is a perspective view showing the first preferred embodiment of the Christmas tree stand with a remote watering system of the present invention.

Turning initially to FIGS. 1–4, and particularly FIG. 1, there is shown a first exemplary embodiment of the Christmas tree stand with a remote watering system of the invention generally designated by reference numeral 20. In its preferred form, Christmas tree stand with a remote watering system 20 comprises generally a Christmas tree stand 30 comprised of a cylindrical base 32 and four legs 40 along with a remote watering box 22 having a top 24.

The remote watering box 22 is preferably camouflaged to look like a Christmas present with simulated gift wrapping. In reality, the box 22 is a watertight and waterproof reservoir which can be filled to its top with water. The lid 24 for the remote watering box 22 should also be made of waterproof materials. Plastic is the preferred choice of materials for both the box 22 and its lid 24.

A water tube 28, preferably made of flexible plastic or rubber hose runs through a hole in the side (near the bottom) of the box 22 to a valve connection piece 50 adjuting from the side (near the bottom) of the cylindrical base 32 of the Christmas tree stand 30. The tube 28 can be hidden under the skirting positioned around a Christmas tree.

The Christmas tree stand 30 has preferably four threaded tree supporting pins 34 which can pass through holes in the side of the cylindrical base 32 and can be turned until they contact a tree supported within the stand 30. Each of the preferably four pins 34 can be tightened as tight as possible to effectively support the tree. Of course a smaller number or a larger number of pins 34 could be effectively used.

The Christmas tree stand 30 also has preferably four foldable supporting legs 40 (one of which can be seen in better detail in FIG. 3) fixed to the cylindrical base 32 by means of pivot pieces 38 which are fixed to the side (near the bottom) of the cylindrical base 32. A knob 40' on the leg 40 (located near one end of the leg 40) passes through a hole in pivot piece 38 to keep the leg 40 fixed to the pivot piece 38 while allowing the leg 40 to rotate about the pivot created by the knob 40' passing through the hole in the pivot piece 38.

The legs 40 are adapted to fold up against the side of the cylindrical base 32 for storage purposes. The folding mechanism is similar to that used for folding up the legs of a folding card table. Each leg 40 is slidably engaged with a belt-shaped brace 42. The preferably metal material belt shaped braces 42 are pivotably fixed to the side of the cylindrical base 32 by means of pivot pieces 36.

A catch knob 44 fixed into the side of each leg 40 is slidably held within each brace 42 between the two "bands" **42*a* and 42*b* of the braces 42. The knob 44 is shown in better detail in FIG. 4. The knob 44 is comprised of a) a wide section 44*a* which is wider than the distance between the two "bands" 42*a* and 42*b* effectively preventing the knob 44 from slipping out between the bands 42*a* and 42*b* of catch knob 44; b) a narrow middle section 44*b* which is narrower than the distance between the two bands 42*a* and 42*b* allowing the brace 42 to slide over the middle section 41*b*; and c) a medium width section 44*c* which is approximately the same width as the distance between the two bands 42*a* and 42*b* so that when the brace 42 is over the middle width section 44*c*** it does not tend to slide without additional force helping it to slide.

Figure 2:
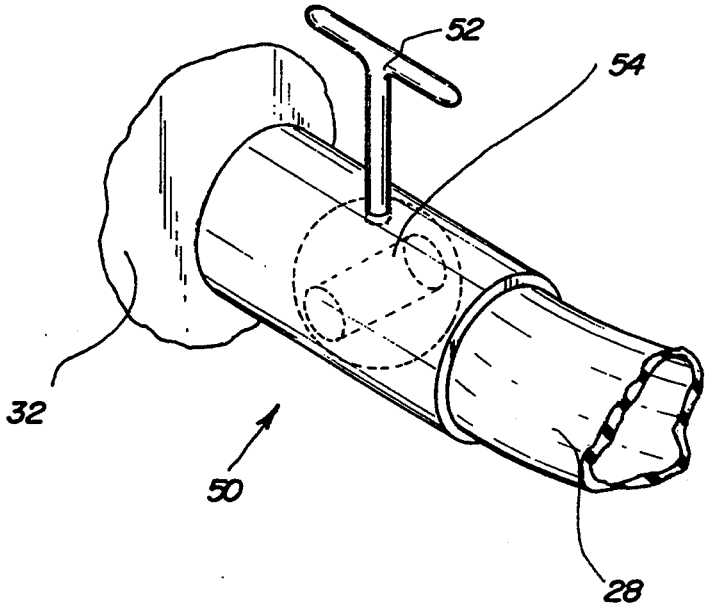
FIG. 2 is a partial cross-sectional elevational perspective view of a ball valve system which can be used with the Christmas tree stand with a remote watering system all in accordance with the present invention.
Figure 3:
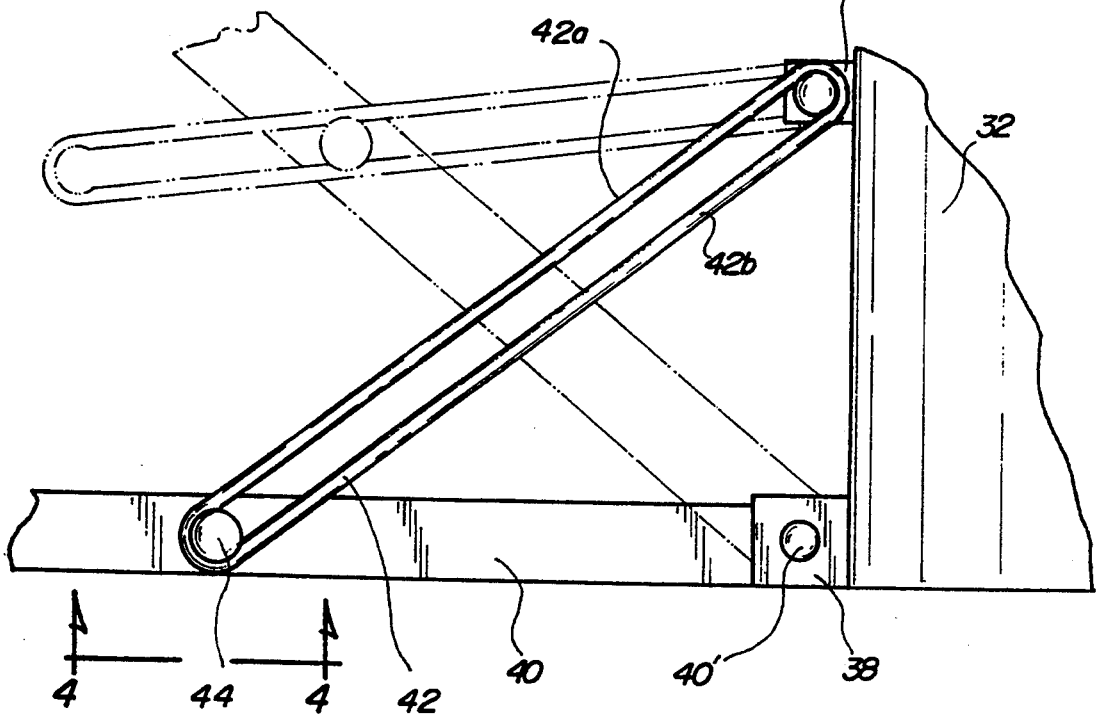
FIG. 3 is a side view of an enlarged part of the Christmas tree stand with a remote watering system of FIG. 1 particularly showing a foldable leg in accordance with the present invention.
Figure 4:
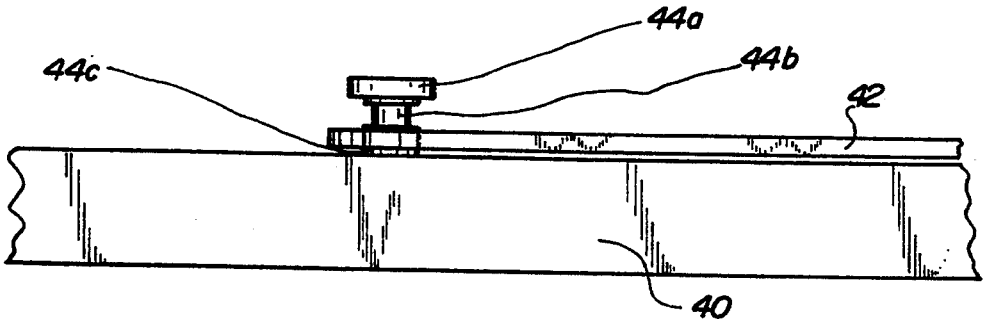
FIG. 4 is a bottom view of the enlarged part of the Christmas tree stand with a remote watering system of FIG. 4 particularly showing a foldable leg in accordance with the present invention.

The ball valve section 50 mentioned above has a T-shaped turning handle piece 52 which can be turned to turn a turning ball valve 54. The valve 54 is shown in FIG. 2 in the closed position. A 45 degree turn of the T-shaped handle piece 52 either way will open the turning ball valve 50 and allow water to flow past (if there is any water being held back by the valve 54).

Use of the Christmas tree stand and remote watering system 20 of the present invention is very easy. The legs 40 of the stand 30 can be spread out to the open position by pulling them downward while the knobs 44 slide along inside the braces 42. At the bottom, the braces can be pushed past the thin width section **44*b* to the middle width section 44*c* of the knob 44 to more securely hold the legs 40 in the open position. Once all four legs 40 are open, the plastic water tube 28 can be attached to the valve section 50. The other end of the water tube 28 can be attached to the water box 22. A tree can be placed within the cylindrical base 32 and the four threaded tree support pins 34 tightened to hold the tree in position in an upright position. The Christmas tree disguised box is moved out away from the stand 30 to an easily accessible area and the tube 28 can be hidden under a skirt used for the Christmas tree. Next, the lid 24 can be removed from the water box 22 and the box 22 can be filled with water. With the valve 54 in the open position the water will flow through the tube 28 into the water tight stand 30 to effectively water the Christmas tree. The person adding the water will know how high the water level is in the stand 30 because it will be the same level in the box 22 since water moves to the same height in two different fluidly communicating reservoirs. The lid 24 can be put back on the box 22 and the lid 24 and box 22** will simply appear to be a present under the tree.

More water can be quickly added when necessary simply by removing the lid 24 from the box 22 and pouring the water in. When the Christmas season is over and it's time to take down the tree, the tree can be removed after untightening the pins 34. Leftover water can be poured out of the box 22 and out of the stand 30 and then the tubing 28 can be disconnected. The legs 40 of the stand 30 can be folded up by first pushing the brace 42 away from the middle width section **44*c* of the knob 44 to the thin width section 44*b* of the knob 44, where it will be easiest for the knob 44 to slide along the brace 44 into the compact folded up position. Once all four legs 40 are folded up, the stand 30 can be placed with the reservoir box 22 along with the tubing 28 and the lid 24** can be put back on and everything can be compactly stored until the next year's Christmas season.

Figure 5:
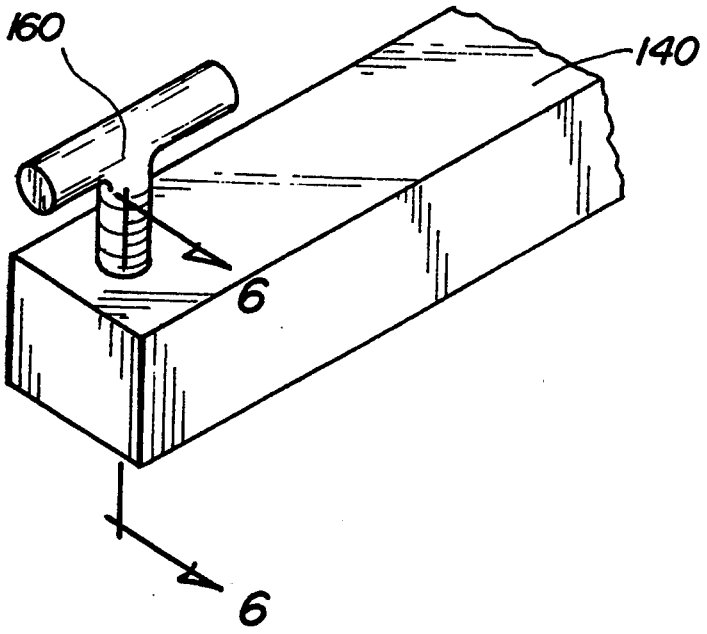
FIG. 5 is a perspective view in elevation of a second preferred embodiment of the present invention having a leveling means for leveling a Christmas tree.
Figure 6:
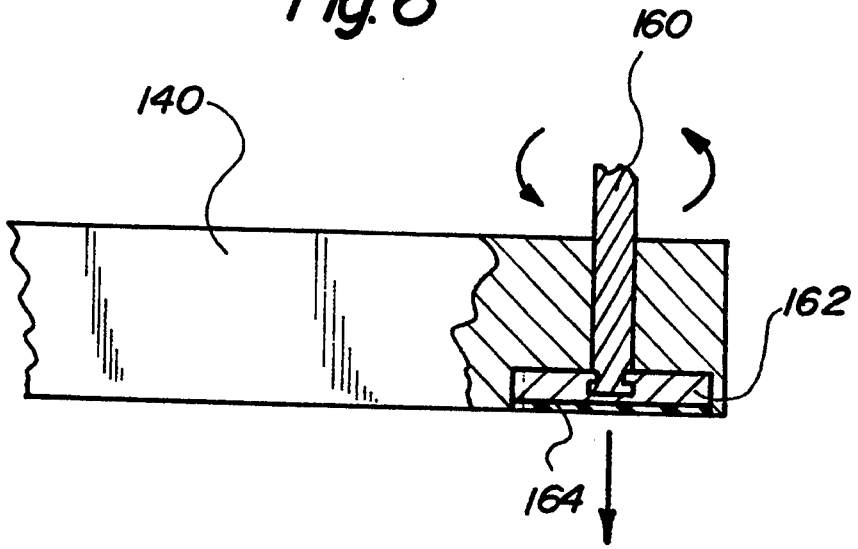
FIG. 6 is a partial cross-sectional side view of the second preferred embodiment of the present invention taken along 6—6 of FIG. 5.

A second preferred embodiment of the present invention is shown in FIGS. 5 and 6. The second embodiment uses specially adapted legs 140 having threaded holes near their end for holding T-shaped threaded levelers 160 which are attached to feet 162. When the T-shaped levelers are threaded down through the hole in the legs 140, the feet 162 are pushed down effectively raising that section of the tree stand. Each of the four legs can be individually adjusted to a different height, such that, if the stand is located on an a slightly angled surface, the heights can be varied to keep the stand (and the water level inside it) level. Pads 164, preferably made of soft rubber, can be attached to the bottoms of the feet 162 to cushion them.

Use of the second embodiment is the same as the first embodiment with the addition of being able to adjust the heights of each of the legs 140 slightly.

Figure 7:
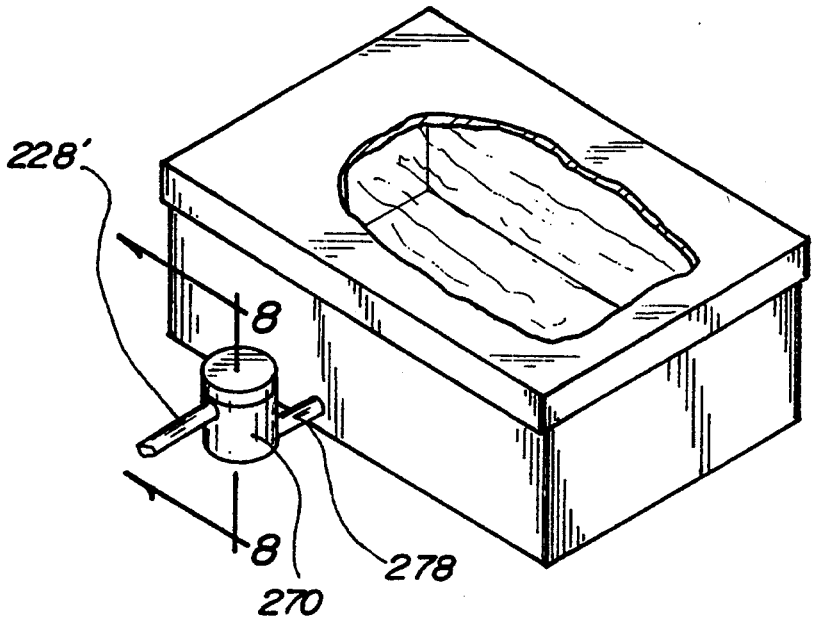
FIG. 7 is a perspective view in elevation of a third preferred embodiment of the present invention having a canister for holding Christmas tree preserving materials in the water line.
Figure 8:
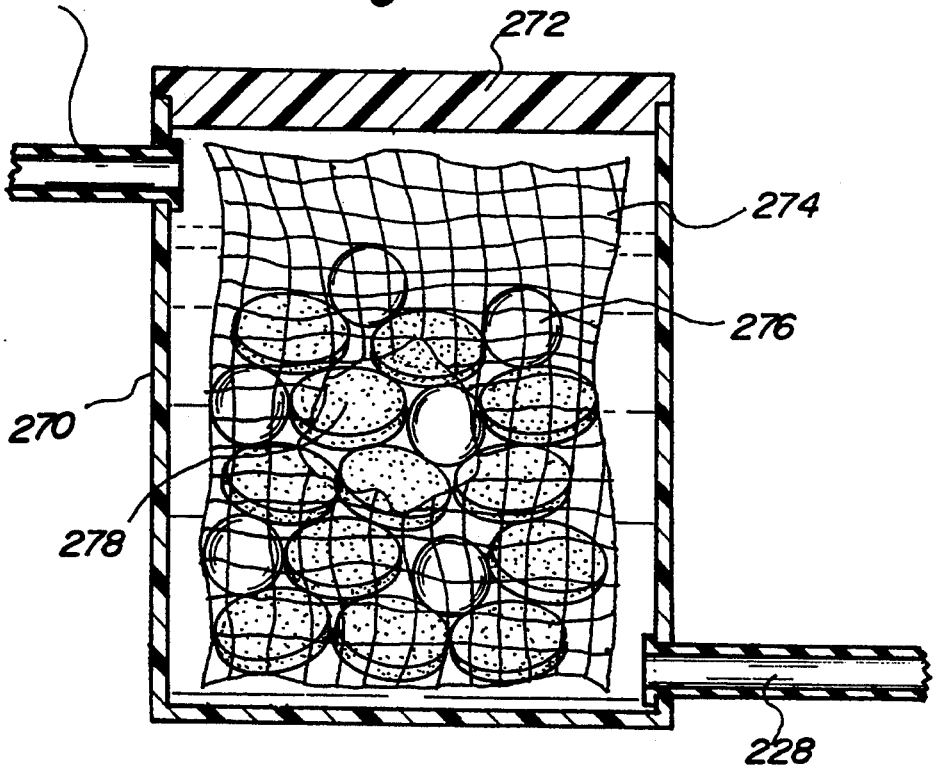
FIG. 8 is a partial cross-sectional side view of the third preferred embodiment of the invention taken along 8—8 of FIG. 7.

A third embodiment of the present invention is shown in FIGS. 7 and 8. The third embodiment further comprises a canister 270 between the water box and the stand. The canister can contain chemicals and other materials for helping to sustain a Christmas tree. In the Figures, inlet tubing 228 brings fresh water to the canister 270. The fresh water passes through a net bag 274 containing, for example, scented gelatin pine oil balls 276 which dissolve in water and tree preserving chemical discs 278. After picking up some of the tree sustaining materials, the water leaves the canister 270 through outlet tubing 228' to the stand. A water tight push on lid 272 is kept on the canister 270 except when it is necessary to change or add more contents.

It is apparent from the above that the present invention accomplishes all of the objectives set forth by providing a new Christmas tree stand with a remote watering system comprising: a stand for supporting a Christmas tree having a plurality of legs adapted to fold between either a Christmas tree supporting position or a compact storage position; a water reservoir remotely located from the stand for holding water for the Christmas tree; a tube means for allowing water from the water reservoir to flow into the stand; wherein the stand and the tube means can fit inside the water reservoir during non-use storage. The water reservoir can have a removable lid and can be camouflaged to simulate a wrapped box Christmas present; such that the water reservoir can be inconspicuously kept near the tree and the lid can be removed to add water to the tree when necessary without anyone having to crawl under the tree. The plurality of legs is preferably four legs. The reservoir and the stand are both preferably watertight and the level of the water in the reservoir will be the same level as the water in the stand. The invention can further comprise a valve means for opening and closing water flow through the tube means between the reservoir and the stand. The invention can also further comprise leveling means in each of the legs for individually adjusting the height of each leg. The invention can further comprise a means for adding treatment to the water for nourishing the tree and/or a for adding treatment to the water to provide a pleasant aroma to the area around the tree. The means for adding treatment can be a canister means.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new Christmas tree stand with a remote watering system comprising:

a stand for supporting a Christmas tree having at least three legs adapted to fold between either a Christmas tree supporting position or a compact storage position;

a water reservoir remotely located from said stand for holding water for the Christmas tree;

a tube means for allowing water from said water reservoir to flow into said stand;

wherein said stand and said tube means can fit inside said water reservoir during non-use storage, wherein said water reservoir has a removable lid and is camouflaged to simulate a wrapped box Christmas present;

whereby said water reservoir can be inconspicuously kept near the tree and said lid can be removed to add water to the tree when necessary without anyone having to crawl under the tree, further comprising leveling means in each of said legs for individually adjusting the height of each leg.

2. The invention of claim 1 wherein said plurality of legs is four legs.

3. The invention of claim 1 wherein said reservoir and said stand are both watertight and the level of the water in said reservoir is the same level of the water in said stand.

4. The invention of claim 1 further comprising a valve means for opening and closing water flow through said tube means between said reservoir and said stand.

5. The invention of claim 1 further comprising a means for adding treatment to the water for nourishing the tree.

6. The invention of claim 1 further comprising a means for adding treatment to the water to provide a pleasant aroma to the area around the tree.

7. The invention of claim 1 further comprising a means for adding treatment to the water for both nourishing the tree and providing a pleasant aroma to the area around the tree.

8. A new Christmas tree stand with a remote watering system comprising:

a stand for supporting a Christmas tree having a plurality of legs adapted to fold between either a Christmas tree supporting position or a compact storage position;

a water reservoir remotely located from said stand for holding water for the Christmas tree;

a tube means for allowing water from said water reservoir to flow into said stand;

wherein said stand and said tube means can fit inside said water reservoir during non-use storage;

wherein said water reservoir has a removable lid and is camouflaged to simulate a wrapped box Christmas present;

whereby said water reservoir can be inconspicuously kept near the tree and said lid can be removed to add water to the tree when necessary without anyone having to crawl under the tree, further comprising a means for adding treatment to the water for both nourishing the tree and providing a pleasant aroma to the area around the tree, and wherein said means for adding treatment is a canister means.

* * * * *